United States Patent [19]

Fay, Sr. et al.

[11] Patent Number: 4,550,861

[45] Date of Patent: Nov. 5, 1985

[54] LACHRYMATOR/DYE DISPENSER

[75] Inventors: James P. Fay, Sr.; James P. Fay, Jr., both of Keene, N.H.

[73] Assignee: Pro-Tex Limited Partnership, Keene, N.H.

[21] Appl. No.: 529,321

[22] Filed: Sep. 2, 1983

[51] Int. Cl.[4] ..... B67B 7/24

[52] U.S. Cl. ..... 222/78; 222/153; 222/399; 251/320

[58] Field of Search ..... 222/78, 129, 136, 145, 222/153, 635, 394, 399, 405, 491–493, 505, 544, 559; 251/319, 320, 324, 90, 101, DIG. 1

[56] References Cited

U.S. PATENT DOCUMENTS

| | | | |
|---|---|---|---|
| 3,272,390 | 9/1966 | Horwitt | 222/153 |
| 4,058,237 | 11/1977 | Luke | 222/78 |
| 4,134,573 | 1/1979 | Messinger | 251/324 |
| 4,241,850 | 12/1980 | Speer | 222/78 X |
| 4,446,990 | 5/1984 | Stevenson et al. | 222/399 X |

*Primary Examiner*—Joseph J. Rolla
*Assistant Examiner*—Michael S. Huppert
*Attorney, Agent, or Firm*—Hayes, Davis & Soloway

[57] ABSTRACT

A dispenser for dispensing a dye and a lachrymator in a stream, comprising a housing defining a closed cavity, a bore extending from the cavity to the exterior of the housing, a spool valve defining a longitudinal axis, disposed in the bore and moveable between open and closed positions, the spool valve being operable from the exterior of the housing and a nozzle extending from the bore to the exterior of the housing, the spool valve with the bore defining a chamber with which the nozzle communicates, the spool valve sealingly engaging the bore, when in the closed position, on both sides of the chamber, to exclude communication between the chamber and the cavity and, when in the open position, permitting communication of the chamber with the cavity whereby when a lachrymator under pressure is present in the interior of the housing, the lachrymator will pass through said chamber to and through the nozzle.

7 Claims, 4 Drawing Figures

LACHRYMATOR/DYE DISPENSER

This invention relates to a lachrymator/dye dispenser in which, upon operation of a valve, a dye immediately followed by a lachrymator is dispensed in a stream from a nozzle under pressure. The invention particularly relates, although not exclusively, to such a dispenser in the general shape of a wristwatch.

Examples of prior art devices capable of dispensing both a primary and a secondary material may be found in U.S. Pat. Nos. 2,895,641, 3,093,596, 3,338,479; and 3,390,820. Examples of prior art in which personal protection devices are disguised as items of jewelry or other personal effects may be found in U.S. Pat. Nos. 4,058,237, 4,061,249, 4,241,850.

There is a need for a legal means of self defense, particularly for joggers, those who work at night or who find it necessary to enter unattended public parking garages, parking lots or other areas where inadequate protection exists. The conventional gas gun or lachrymator dispenser would be effective in most cases if they were readily at hand, which due to their design they usually are not. Further, it would be most advantageous if the device could mark the would-be attacker with an indelible dye to aid later identification.

It is an object of the present invention to provide an inexpensive, simple and reliable dispenser adapted to be worn by the user at a location in which it comes readily to hand when needed and which will dispense a dye and a lachrymator.

The present invention provides a dispenser for dispensing a dye and a lachrymator in a stream, comprising a housing defining a closed cavity, a bore extending from the cavity to the exterior of the housing, a spool valve defining a longitudinal axis, disposed in the bore and moveable between open and closed positions, means for operating the spool valve from the exterior of the housing and a nozzle extending from the bore to the exterior of the housing, said spool valve with said bore defining a chamber with which said nozzle communicates, said spool valve sealingly engaging said bore, when in the closed position, on both sides of said chamber, to exclude communication between said chamber and the cavity and, when in the open position, permitting communication of said chamber with the cavity whereby when a lachrymator under pressure is present in the interior of the housing, said lachrymator will pass through said chamber to and through said nozzle.

The present will now be described, by way of example, with reference to the accompanying drawings, in which.

Figure 1:
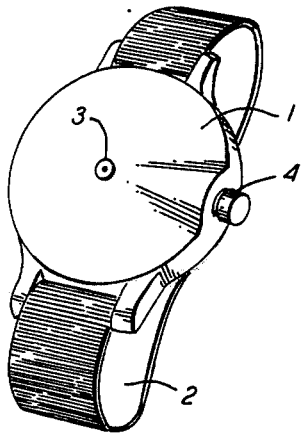
FIG. 1 is a perspective view of a dispenser according to the present invention having the shape of a wristwatch.

With reference to FIG. 1, the lachrymator/dye dispenser of the present invention has a housing 1 in the general shape of a wristwatch which carries a strap 2 to support the dispenser on a wrist. The housing has a centrally disposed nozzle 3 on the face of the housing, which is exposed when it is on a wrist, and a valve operating stem 4 projecting therefrom.

Figure 2:
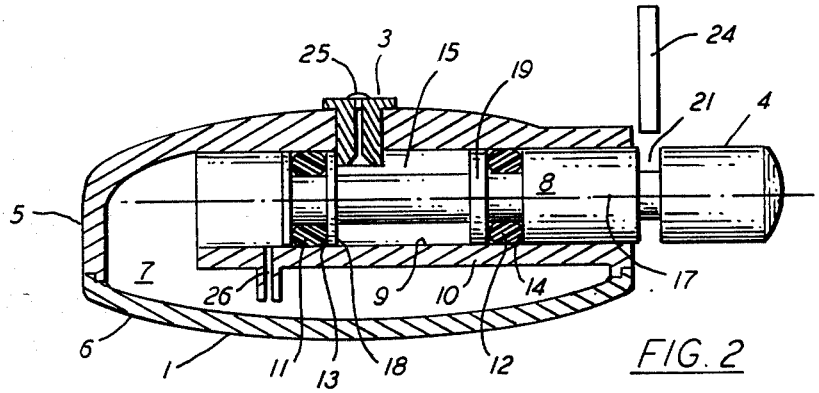
FIG. 2 is a diagrammatic partially sectional elevation through the valve structure of the device shown in FIG. 1 with the valve shown in its closed position ready for operation.

With reference to FIG. 2, the housing 1 consists of two mating plastic moldings 5 and 6 connected together by an adhesive to form a closed cavity 7, communication to the exterior of the housing from which is controlled by a spool valve 8 housed within a cylindrical bore 9 defined by a structure 10 integrally formed with the molding 5. The spool valve 8 comprises two O-rings 11 and 12 housed in O-ring grooves 13 and 14, respectively. The O-rings 11 and 12 are both in sealing engagement with bore 9 and are disposed one on either side of an annular recess 15 to which the exterior of the housing 1 communicates by way of the nozzle 3. The nozzle 3 projects into the bore 9 to act as a retaining stop to limit longitudinal movement of the spool valve 8 along its axis 17 by engagement, when the valve is closed, with the flange 18 which partially defines the O-ring groove 13 and by engagement, when the valve is open as shown in FIG. 3, with the flange 19 which partially defines the O-ring groove 14.

Figure 3:
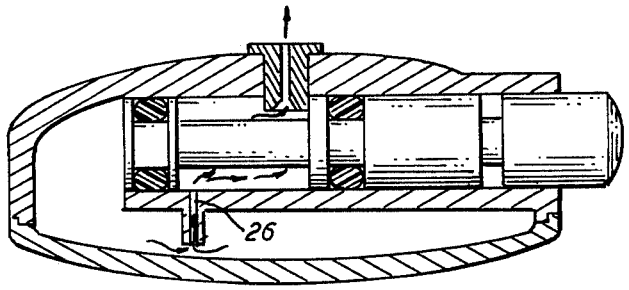
FIG. 3 is a diagrammatic partially sectional elevation similar to that of FIG. 2 with the valve shown in a position in which a dye and lachrymator will be dispensed.

The longitudinal movement permitted by the nozzle is sufficient to move the spool valve from its closed position as shown in FIG. 2 to its open position as shown in FIG. 3. In this open position, O-ring 11 is moved longitudinally past an orifice 26 to permit flow of a fluid, housed in the cavity, through orifice 26 and by way of the chamber defined by the annular recess 15 and bore 9, and the nozzle 3 to the exterior of the housing. The spool valve carries the stem 4, which projects from the housing in a position similar to that of the stem of a wristwatch, to facilitate movement of the valve into the open position shown in FIG. 3 when desired. When the valve is closed as shown in FIG. 2 a safety groove 21 is exposed between the housing and the stem in order that there may be accommodated therein a safety spring clip 24 (shown adjacent the stem only in FIG. 2) adapted to prevent operation of the valve when accidental operation is to be avoided. As with the housing, the nozzle and spool valve may be plastic moldings.

The cavity 7 of the housing 1 is adapted to house a nitrogen pressurized lachrymator, while the chamber defined by the annular recess 15 and bore 9 houses an indelible dye. Prior to use of the dispenser a plug 25 in the nozzle 3 prevents escape of the dye.

In operation, the dispenser is normally disposed with the valve in its closed position as shown in FIG. 2. When operation of the dispenser is desired, the stem 4 is depressed to move the spool valve longitudinally, to the left as shown in FIGS. 2 and 3, while the nozzle 3 is directed toward the target. When the spool valve has moved sufficiently for the O-ring 11, the nitrogen pressurized lachrymator is driven into the chamber defined by the annular recess 15 and bore 9 driving before it the indelible dye. By this action the indelible dye ejects the plug 25 and is then itself ejected in a stream from the nozzle 3. The ejected dye is immediately followed by lachrymator under pressure. Accordingly, the target at which the nozzle is directed will first be marked by the indelible dye and then be struck by a stream of lachrymator. Upon release of the stem 4, any remaining pressure of freon in the housing will serve, by virtue of differential pressure action on the spool valve, to move the valve longitudinally into its closed position as shown in FIG. 2.

Figure 4:
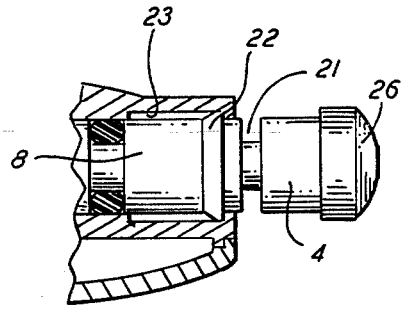
FIG. 4 is a fragmentary view of a portion of the valve of the dispenser showing an alternative method of retaining the valve within the housing thereof.

With reference to FIG. 4, there is shown an alternative arrangement for holding captive the spool valve in the bore 9. Using this arrangement will eliminate the need for a separate nozzle and in such circumstances the nozzle may be a simple opening in the face of the housing. In this arrangement the material from which the spool valve is constructed carries adjacent the safety groove 21 an annular chambered flange 22 and the valve and/or housing is constructed of a material sufficiently resilient to permit the flange 22 to be forced through the entrance to the bore 9, this opening being of a smaller diameter than the diameter of flange 22, into an annular recess 23 located in the bore 9 adjacent the connection of the spool valve to the stem 4. The longitudinal extent of the recess 23 is sufficient to permit the valve to be opened upon depression of the stem while the stem has a portion 26 of such a diameter as to limit longitudinal movement of the spool valve to its open position, as shown in FIG. 3, by abutment of the stem with the housing 1.

As used herein the item "dye" includes intermediates, such as ninhydrin; ninhydrin being a reagent for the detection of free amino and carboxyl groups, proteins and peptides, yielding a blue color under suitable conditions.

We claim:

1. A dispenser for dispensing a dye and a lachrymator, comprising a housing defining a closed cavity, an open ended bore extending from the cavity to the exterior of the housing, said bore having an orifice located in its sidewall in communication with said cavity, a spool valve defining a longitudinal axis, disposed in the bore and moveable between open and closed positions, a nozzle extending from the bore to the exterior of the housing, said spool valve with said bore defining a chamber with which said nozzle communicates, said spool valve sealingly engaging said bore, when in the closed position, on both sides of said chamber, to exclude communication between said chamber and the cavity and, when in the open position, said orifice permitting communication of said chamber with the cavity whereby when a lachrymator under pressure is present in the interior of the housing, said lachrymator will pass through said chamber to and through said nozzle, and means for opening said spool valve from the exterior of the housing, differential pressure when present between the interior of the housing and the exterior of the housing serving to move said spool valve to its closed position.

2. A dispenser according to claim 1 wherein the chamber is for housing said dye and the lachrymator drives the dye before it through the nozzle when the valve is in its open position.

3. A dispenser according to claim 1, wherein the sealing engagement of said spool valve with said bore is by means of two O-rings only disposed in O-ring grooves in said spool valve one on either side of the chamber.

4. A dispenser according to claim 3, wherein the nozzle is defined by a nozzle member extending into said bore for abutment with annular flanges defining opposite ends of the chamber to limit longitudinal movement of the spool valve along the longitudinal axis thereof from its fully open to its fully closed position.

5. A dispenser according to claim 4, wherein the means for operating the spool valve is a stem projecting from the housing, a safety groove being disposed between the stem and the spool valve and positioned, when the valve is in its closed position, to accommodate a safety clip between the stem and the housing to prevent accidental operation of the valve.

6. A dispenser according to claim 5, wherein the housing comprises two moldings interconnected to define the closed cavity of the housing.

7. A dispenser according to claim 3, wherein the orifice interconnects said cavity and said chamber only when the valve is in its open position, said orifice extending laterally of the longitudinal axis through the housing from the cavity to the bore.

* * * * *